US005170834A

United States Patent [19]

Purman et al.

[11] Patent Number: 5,170,834

[45] Date of Patent: Dec. 15, 1992

[54] MOLD MAKING MACHINE AND METHOD OF MAKING MOLDS

[75] Inventors: Fred V. Purman, Reading, Pa.; Paul G. Buetow, Freeland; Charles L. Rose, Bridgeport, both of Mich.

[73] Assignee: General Motors Corporation, Detroit, Mich.

[21] Appl. No.: 749,754

[22] Filed: Aug. 26, 1991

[51] Int. Cl.[5] ..... B22C 9/02; B22C 15/10

[52] U.S. Cl. ..... 164/29; 164/39; 164/168; 164/169; 164/203

[58] Field of Search ..... 164/39, 37, 38, 29, 164/159, 169, 168, 203

[56] References Cited

U.S. PATENT DOCUMENTS 4,553,581 11/1985 Uppgren et al. ..... 164/29 X
4,628,986 12/1986 Southam ..... 164/159
4,753,282 6/1988 Burnett ..... 164/159 X

OTHER PUBLICATIONS

*Metals Handbook*, 8th Edition, vol. 5, pp. 164–165, 1970.

*Primary Examiner*—J. Reed Batten, Jr.

*Attorney, Agent, or Firm*—Lawrence B. Plant

[57] ABSTRACT

A cope flask is precisely centered relative to a cope pattern by a flask displacement mechanism affixed to a cope stool which lineraly shifts the flask relative to the pattern while taking up clearance between the locator pins of the cope flask and the locator bushing in the stool. This precision centering is maintained while mold sand is poured into the flask and compacted. The cope mold comprising the flask and the hardened sand is stripped from the stool for subsequent mating with a drag mold made in a similar manner but with the drag stool having locator pins secured in its top surface and the locator bushings provided in the drag flask. As with the cope mold making procedure, the drag flask is precisely centered relative to the drag pattern by linearly moving the drag flask to take up clearance between the centering pins and the centering bushings in the drag with the displacement mechanism. The flask displacement mechanisms for the cope and drag are low mass pneumatically actuated units attached to the stools that effectively provide the flask displacement force while allowing jolting and mold sand compacting without adversely affecting mold making machine balance.

6 Claims, 7 Drawing Sheets

MOLD MAKING MACHINE AND METHOD OF MAKING MOLDS

TECHNICAL FIELD

This invention relates to a new and improved machine and method for making sand molds providing enhanced alignment of mold halves in which the parting line offset is eliminated or substantially reduced in parts cast by the sand molds made by this invention.

BACKGROUND OF THE INVENTION

Description of related art: U.S. Pat. No. 4,628,986 issued Dec. 16, 1986 to D. L. Southam discloses a mold making apparatus in which the cope and drag flasks are urged against flask locator stop members external of the flasks and at right angles with respect to one another by right angularly disposed pusher mechanisms. This centers the flasks with respect to patterns located on the support plate. With the mold halves made with greater precision, improved alignment and registration of the mold halves is obtained to reduce the amount of step at the parting line of the molded part.

The publication *Metals Handbook,* 8th Edition, vol. 5, published by the American Society for Metals, Metals Park, Ohio 44073, Copyright © 1970, discloses on pages 164 and 165 jolt type and jolt-squeeze type molding machines and methods for making sand molds in which flasks are centered relative to patterns seated on a pattern support plate by the use of centering locator pins. After a flask is positioned by the centering locator pins, mold sand is poured into the flask so that the pattern is completely covered. Then the pattern support plate and the pattern with the surrounding flask and sand are jolted by a fluid operated piston mechanism so that the sand is compacted by its own weight around the pattern and is hardened. When this jolting is completed, push off pins are brought into contact with the lower surface of the flask and are stroked upward to push the flask and the contained hardened sand as a unit from the pattern to complete a mold half. In a jolt-squeeze molding machine, the sand is further compacted after jolting by raising the flask and sand against floating peen blocks extending from an upper compensating head. As with jolt type mold making machines, push off pins are employed to move the mold from the pattern plate, the pattern and the centering pins.

SUMMARY OF THE INVENTION

In the present invention and in contrast to the referenced patent disclosure, the cope and drag molds are made by utilizing existing alignment pins and bushings within the mold flask, and mold support together with a flask displacement device to effect new and improved alignment of the cope and drag flasks relative to their respective patterns. When the molds are made with this invention and ultimately mated for casting purposes, a cavity is formed in which the parting line step is eliminated or reduced in dimension to meet new requirements and higher standards for reduced parting line offsets of the molded part, and to provide a molded part that reduces finishing burdens and is aesthetically more acceptable.

Furthermore, with this invention there is minimized and controlled shifting of the flask relative to its pattern and the shifting mechanism provided is of minimized weight for advantageous integration with the pattern support provided by a stool so that stability is maintained during jolting. When jolted, the stool and attached flask shifting mechanism is displaced along with the flask and other components of the molding machine so that wear between the shifting mechanism and the flask is minimized. Also, the centering force is constantly maintained during jolting for improving the positional accuracy in making of the mold.

In a preferred embodiment of this invention, a cope flask fitted with guide and locating pins is positioned on a pattern plate or stool on which a sand mold pattern has been installed in a predetermined position. When the guide pins of the cope flask enter the openings provided by guide pin bushings provided within the pattern plate, the cope flask is guided into a preliminary position in which flask mounted locator pins are in alignment with locator pin bushings also in the pattern plate so that when fully seated the cope flask is positioned in a preliminary position that is substantially centered with respect to the pattern. However, since there is normal clearance between the flask locator pins and the bushings in the pattern plate, a wide tolerance remains between the flask-pattern centering.

This invention uniquely eliminates or reduces the naturally occurring locator pin and pin bushing clearance by shifting the flask on the pattern plate until axial clearance in one direction between the locator pin is diminished to zero effecting precision location of the cope flask relative to its pattern thereby enhancing the accuracy of flask-pattern position well beyond that obtained with the locator pins and associated bushings by themselves.

This positioning is achieved by a new and improved flask displacement mechanism connected to a flask and pattern support stool involving a pneumatically charged bladder that provides the desired force that acts through lever arm construction spring hinged to the stool on which the pattern is positioned. With the flask-pattern so centered under the substantially linear force of the pneumatic mechanism, mold sand can be fed into the flask and pressed under load while the stool is being vibrated so that a high quality cope mold is made.

The drag mold is made in a similar manner except the drag flask is provided with locator pin bushings, which are adapted to receive matching locator pins, which are press fitted into bushing in the pattern plate or the upper surface of the drag stool. Clearance between the drag mold bushing and the pins in the stool is effectively eliminated by the pneumatic bladder providing the centering force so that the drag flask will be more precisely and repetitively centered with respect to the drag pattern each time a mold is made with sand by jolting and squeezing the sand, as described above.

With precisely centered cope and drag molds stripped from their patterns, there is minimized or no offset of the cope and drag core cavities. Accordingly, this invention provides improved sand mold castings by the employment of precisely made sand mold halves that, when mated, have their parting line offset determined by the clearance between the cope and drag mold locator pins and associated bushings.

With this invention the molds are accordingly uniform since the patterns and flasks are located at the same relative position each time a mold is made. When the cope and drag molds are put together for molding purposes, the only variation is the allowable clearance between the locator pins and the bushings in the cope and drag molds.

These and other features, objects and advantaged of this invention will become more apparent from the following Detailed Description and Drawings in which:

DETAILED DESCRIPTION OF THE PREFERRED EMBODIMENTS

Figure 1:
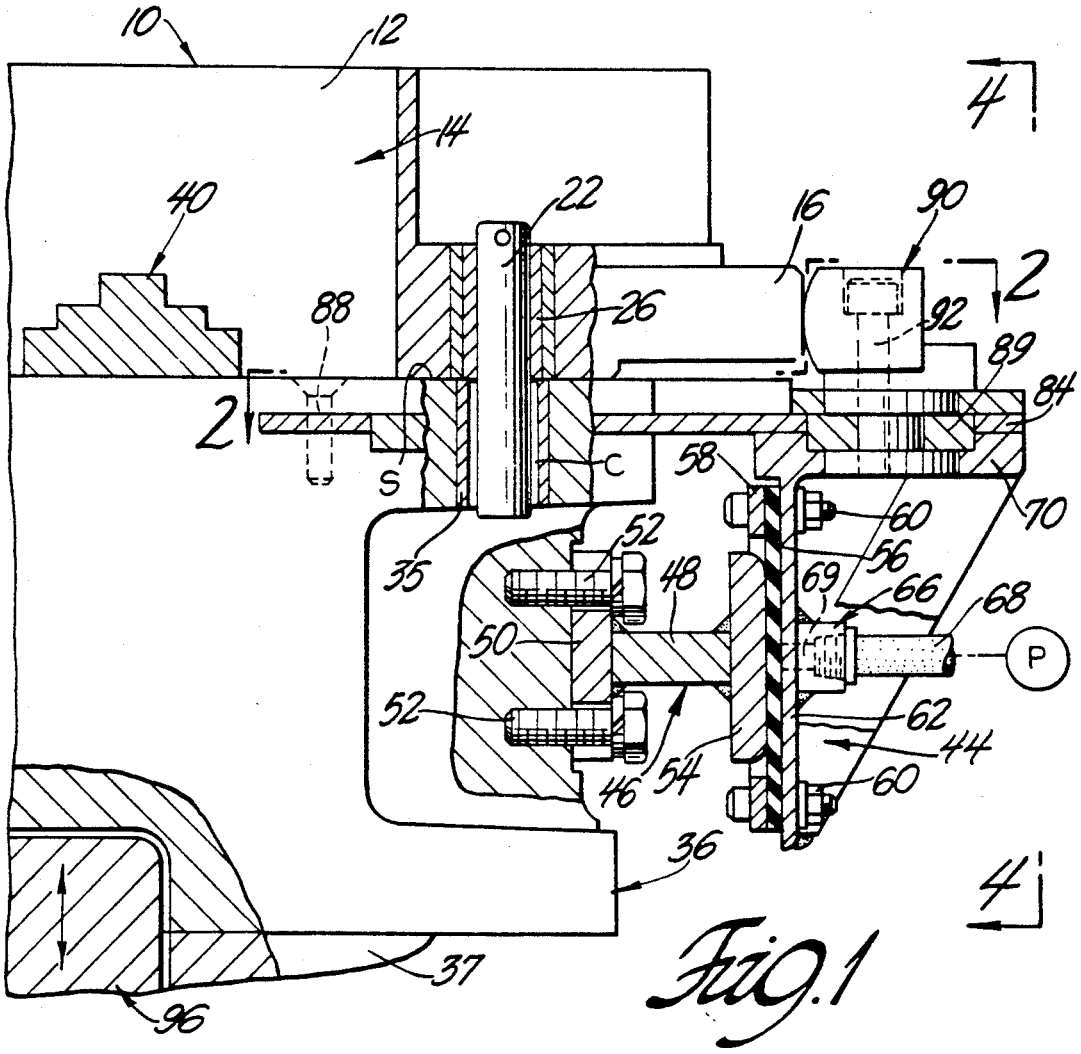
FIG. 1 is a diagrammatic cross sectional view with parts cut away of a portion of a cope mold making machine.
Figure 3:
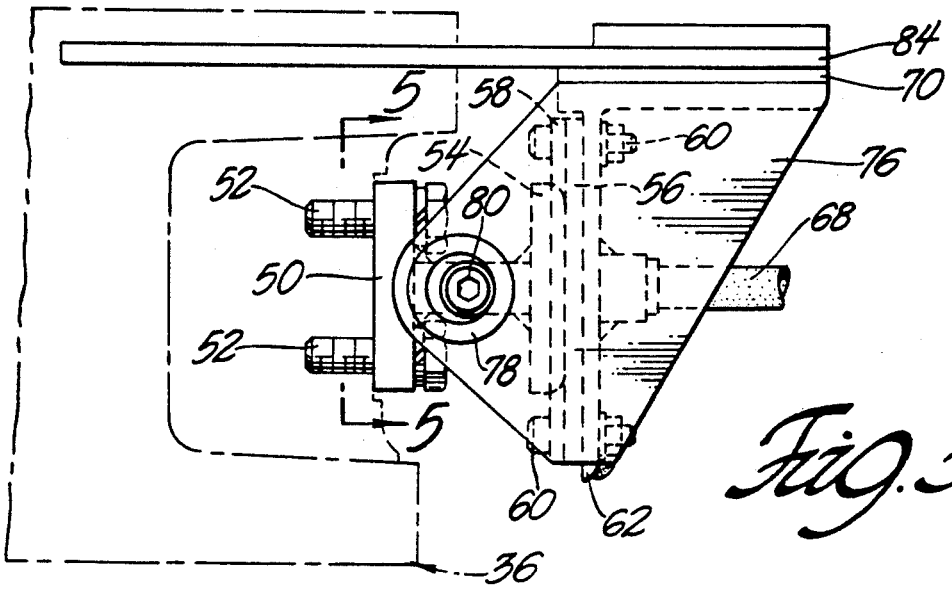
FIG. 3 is an end view taken generally along sight lines 3—3 of FIG. 2 showing the pivotal attachment of the flask displacement mechanism of this invention to the cope pattern stool.
Figure 6:
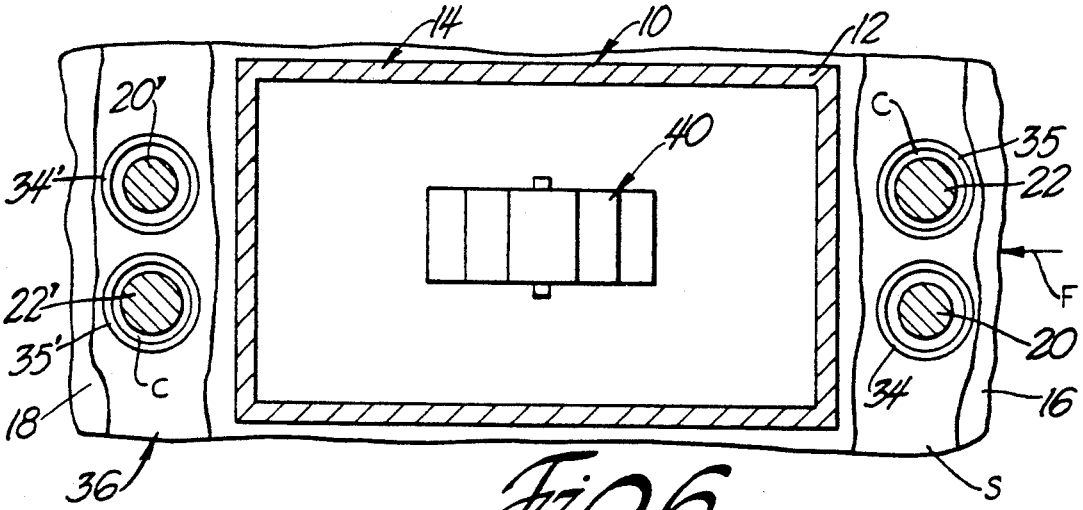
FIG. 6 is a diagrammatic top view of a cope flask with parts broken away and a cope pattern before final centering by the flask displacement mechanism of this invention.
Figure 7:
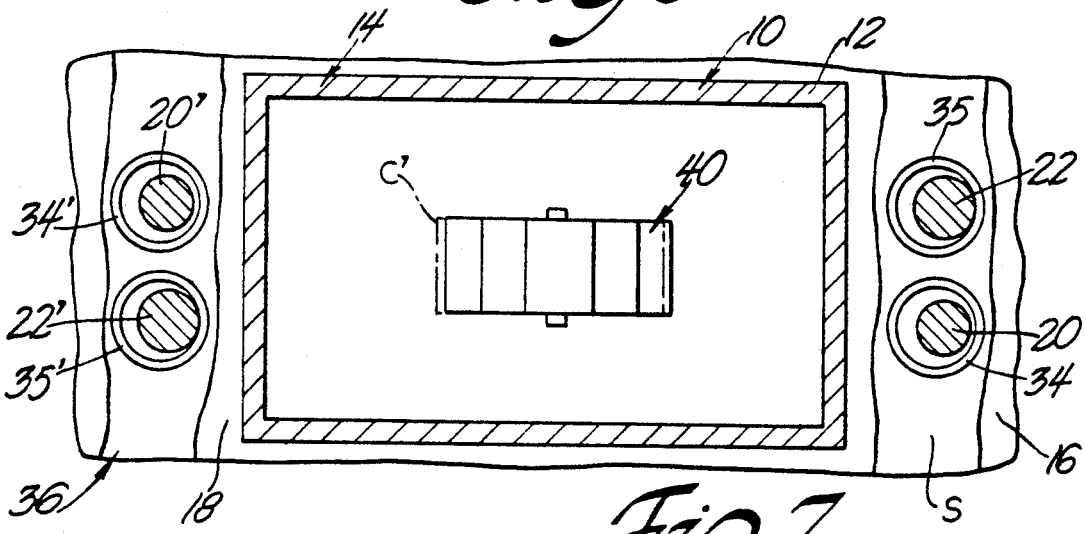
FIG. 7 is a view similar to the view of FIG. 6 showing the cope flask and stool and pattern after final centering.

Turning now in greater detail to the drawings, there is shown in FIGS. 1, 6 and 7 a cope flask 10 having upstanding retainer walls 12 that define a rectilinear open ended frame 14, which essentially provides the external peripheral limits of the cope sand mold according to this invention. Extending outward from base portions of opposite end walls 12 of the cope flask are end flanges 16 and 18, which have guide pins 20 and, 20' and locator pins 22 and 22' press fitted respectively in support bushings such as support bushing 26 of FIG. 1 that are mounted in corresponding openings in these flanges. The guide pins and locator pins are diagonally spaced from one another across the flask opening from one another, as illustrated.

The guide pins 20, 20' are longer but are slightly smaller in diameter as compared to the locator pins 22,22' and extend perpendicularly from the lower surfaces, of the flanges 16 and 18 and, as diagrammatically illustrated in FIGS. 6 and 7, are adapted to be received in guide pin bushings 34, 34' provided in the top of a cope pattern stool 36 mounted on a support 37.

More particularly, when the cope flask 10 is lowered onto the cope pattern stool, the guide pins 20,20' enter the guide pin bushings 34, 34' to guide the locator pins 22, 22' into their associated bushings 35, 35' also provided in the upper surface S of the cope pattern stool until the cope flask is fully seated thereon. When seated, the cope flask compasses a cope mold pattern 40 which has been loaded and secured in a predetermined position on the top of the cope pattern stool. In this position shown in FIG. 6, the cope flask is in a generally centralized position relative to the cope mold pattern with deviation from true center that in most instances equals the dimension of annular clearance C (FIG. 1) normally occurring between the outer diameter of the locator pin 22 and the internal diameter of the locator pin bushing 35 in the cope stool. This clearance may, for example, amount to 0.010 inch and a sand mold made with such centering could have a centering error of that measure.

While such clearance is relatively small, the clearance between a drag pattern and its drag flask may also have a centering error of 0.010 in. with similar pin and bushing centering. When sand molds are made with such offset centering and assuming the same centering offset occurs between the cope and drag molds, the combined or overall offset would amount to 0.030 so that a molded part would have a 0.030 in. step at the parting line. Such offsets are not desirable in many instances since machining, or other additional work and expense, would be required to bring the molded part to desired specifications.

Molding experience with cope and drag molds has shown that mold pattern and flask centering is most important in one direction such as along the x axis of planar coordinates. Accordingly, this invention primarily eliminates clearance along that axis to effect a close tolerance and improved flask-pattern centering which results in augmented cope mold-drag mold centering. There is, however, a measured improvement in location of the flask along "Y" axis since the contact of the locating pins and their associated bushings involves arcuate contact so that there is positional correction in both coordinates.

In the preferred embodiment of this invention, such centering is accomplished by a flask displacement mechanism 44 comprising a support bracket 46 that has an elongated main body 48 with laterally spaced pads or feet 50 welded thereto on one side and secured by screws to 52 to one end of the cope pattern stool 36.

Secured by welds to the other side of the body 48 of the support bracket 46 is an elongated, head portion 54 having a wide front face which form a backing for an elongated bladder 56 of a suitable elastomer material. This bladder is secured at its periphery by a frame-like retainer 58 and spaced threaded fasteners 60 extending through the depending leg 62 of the flask displacement mechanism 44 which is generally L-shaped in cross section. The outboard side of the vertical leg 62 of the displacement mechanism has a fitting 66 which receives the terminal end of a hose 68 which transmits on demand low pressure air 40 to 50 psi, for example, from a source P. As shown, the depending leg 62 has an opening 69 drilled therethrough which leads to the interface formed between the bladder 56 and the inboard side of the depending leg 62.

Figure 2:
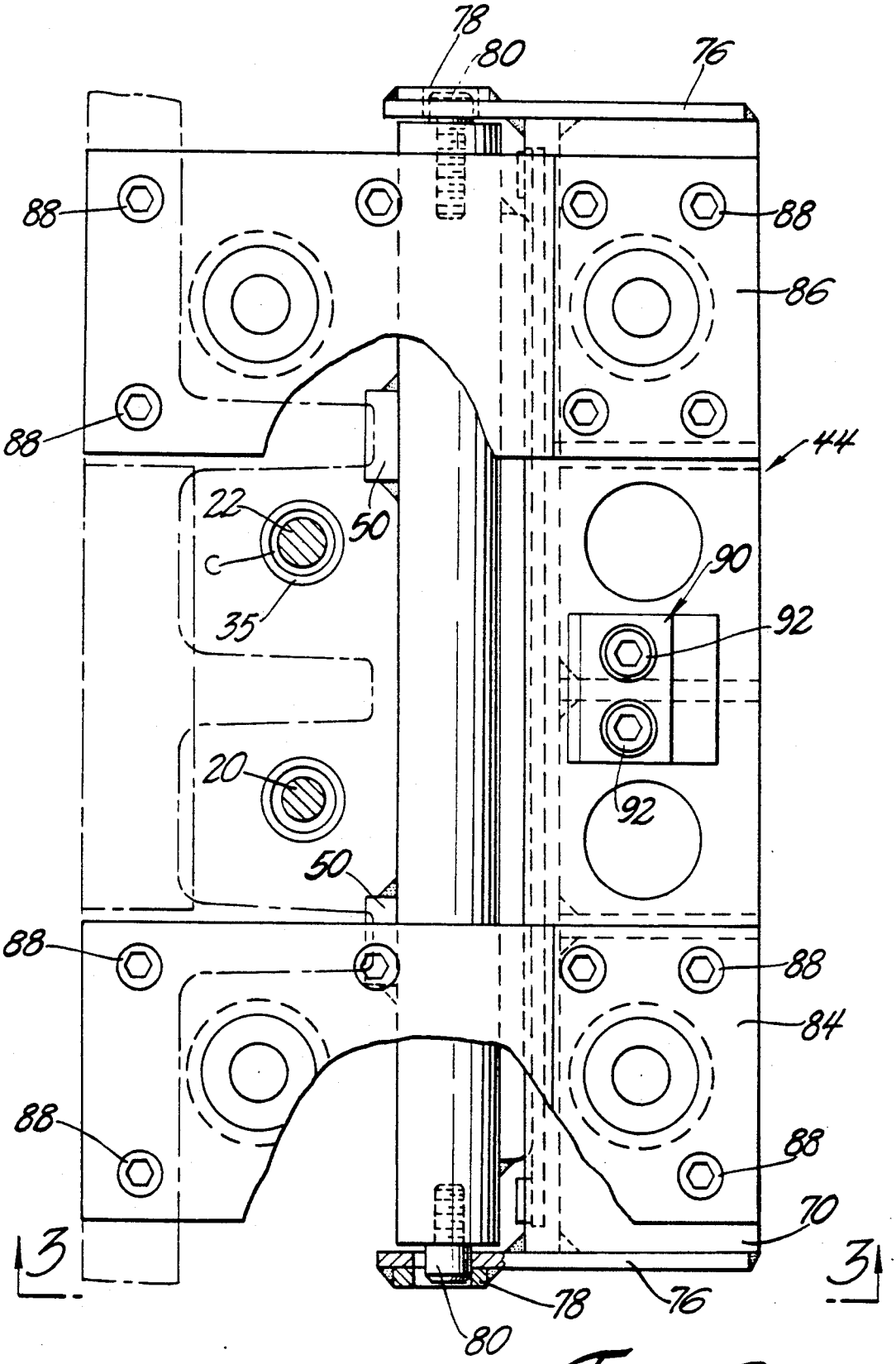
FIG. 2 is a view taken along sight lines 2—2 of FIG. 1 showing a top view of the cope mold making machine.
Figure 4:
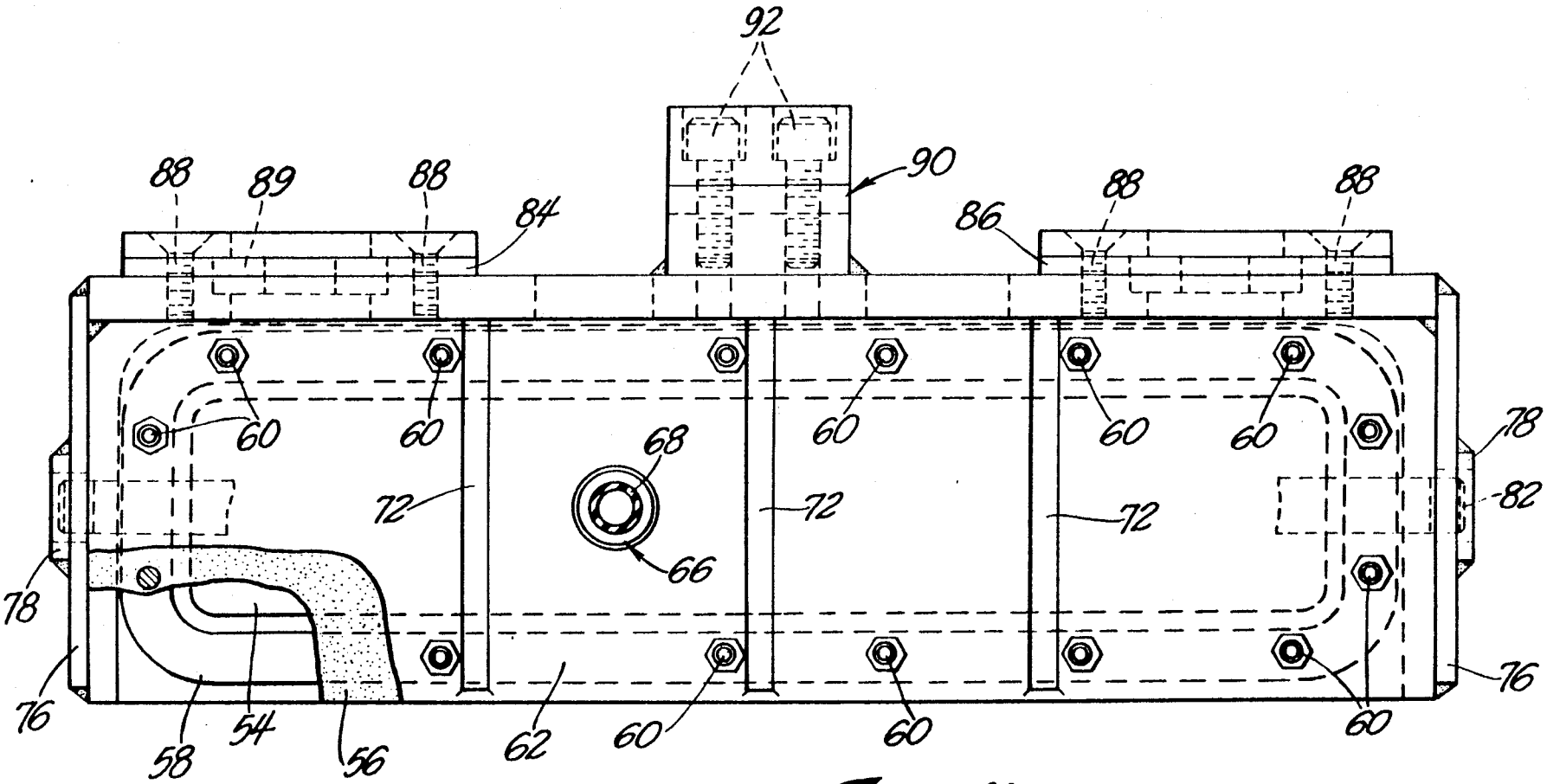
FIG. 4 is an end view taken along sight lines 4—4 of FIG. 1.
Figure 5:
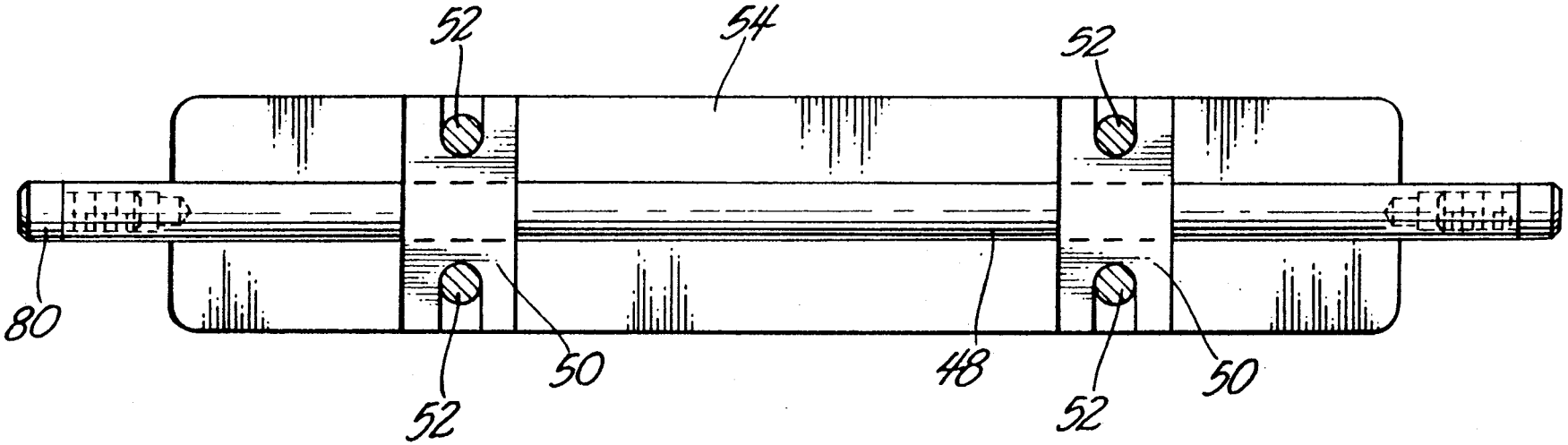
FIG. 5 is an end view of a support bracket of the flask displacement mechanism taken generally along sight lines 5—5 of FIG. 3.

The flask displacement mechanism 44 has a generally horizontal leg 70 extending outboard from the upper end of leg 62 which is supported by laterally spaced braces 72 connecting the horizontal and vertical legs of the flask displacement mechanism, as shown in FIGS. 1 and 4. This flask displacement mechanism has a pair of end plates 76 which extend from connection with the horizontal and vertical legs 62 and 70 across the ends of the connector body of the support bracket, as shown in FIG. 2. These end plates have bushings 78 welded thereto which receive the cylindrical heads of pivot pins 80 threadedly connected into the ends of the connector body of the support bracket 46.

The flask displacement mechanism 44 is spring biased to the FIG. 1 position by a pair of elongated, flat springs 84 and 86 which are secured by threaded fasteners 88 to the cope stool 36 and to the horizontal leg 70 of the flask displacement mechanism. Annular keys 89 are also employed as retainers.

As best shown in FIG. 2, the springs 84, 86 are inboard of the pivotally mounted end plates 76 and function to return the flask displacement mechanism from position as moved by the air charged bladder 56 back to the FIG. 1 position when pneumatic pressure is exhausted from the bladder.

Disposed on the horizontal leg 70 and intermediate the ends of the spring 86 as attached thereto is an upstanding contact member 90 that is secured to the upper side of the leg 70 by threaded fasteners 92. In operating position with the flask in its preliminary centered position aboard the cope stool, the contact member 90 engages the end of flange 16 of the flask 10.

When pressurized with shop air pressure from source P, the flask displacement mechanism 44 will turn on the pivot pins 80, 82 overcoming the force of the springs 84, 86 so that a linear force F is applied against the flask 12, as diagrammatically illustrated in FIG. 6. This force will move the flask from the FIG. 6 to the FIG. 7 position in which clearance C is taken up between the outer periphery of the locator pins 22 and 22' and the adjacent inner diameter surfaces of the locator pin bushings 35, 35' in the cope pattern stool, as shown in FIG. 7. When this clearance is removed, the cope flask 40 is axially displaced at distance C' equal to clearance C and centered with respect to the inner periphery of the cope flask walls 12. After this centering is achieved, molding sand, a mixture of sand, clay and water, is poured into the flask opening to fully cover the pattern 40. The cope pattern stool is jolted by ram jolt piston 96 and a compensation head with peen blocks can be used to effect the compacting of the molding sand around the pattern. When hardened, the cope pattern is stripped from the cope pattern stool with the cavity formed by the pattern 40 corresponding to the periphery of the pattern. While being jolted, the pressure remains in the bladder so that the centering is maintained. During this positioning, the guide pins having a diameter less than that of the locator pins do not contact the inner diameter of their bushings so that their function remains the same and play no substantial role in the final centering step of this invention. After being stripped, the stool and pattern are prepared to receive another flask which is centered, as described, for reception of molding sand for the manufacture of another cope mold.

Figure 9:
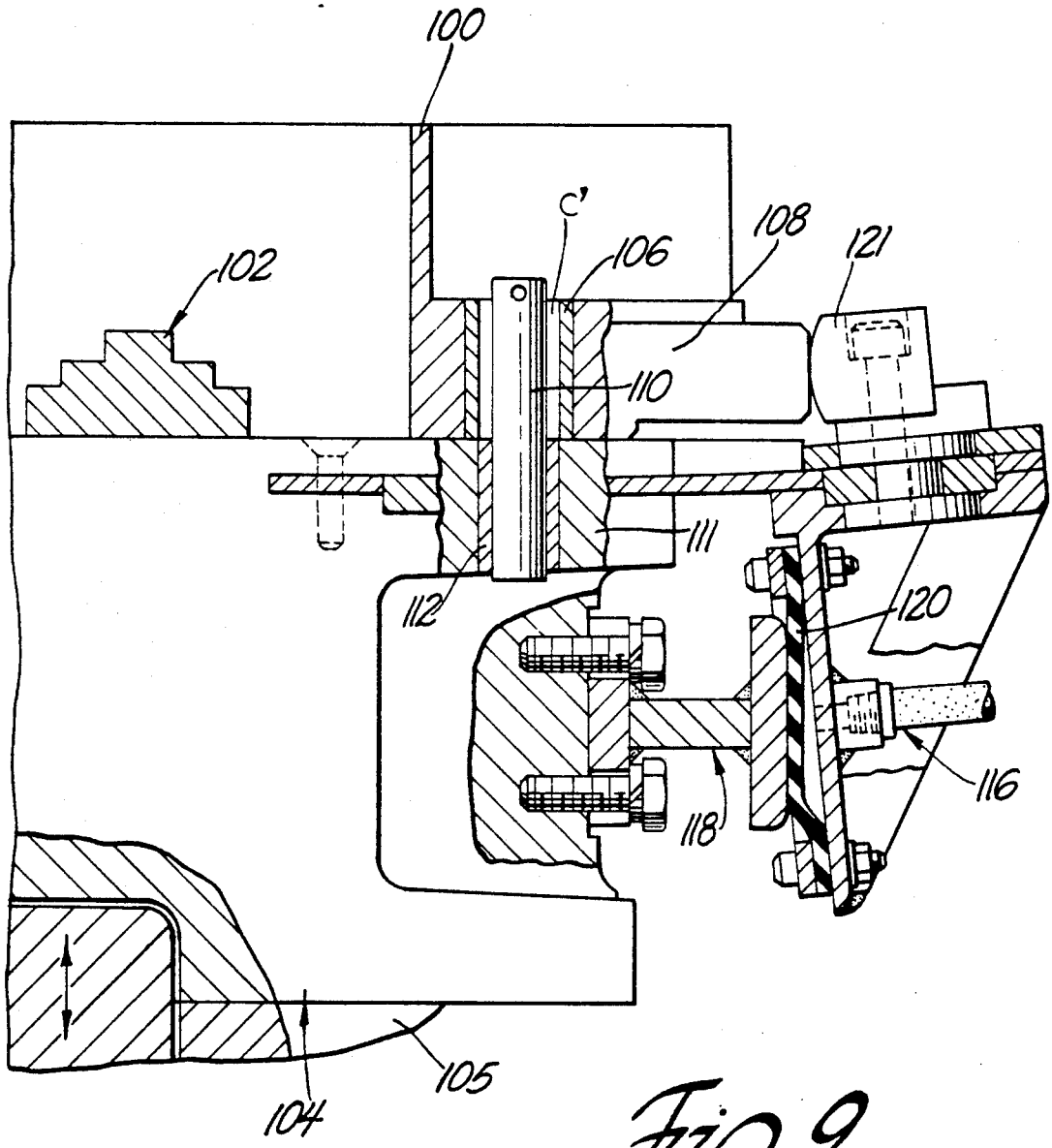
FIG. 9 is a diagrammatic cross sectional view similar to the view of FIG. 1 illustrating a drag mold making machine.

Turning now to FIG. 9, a construction similar to that of FIGS. 1-5 is shown for positioning a drag flask 100 relative to a drag flask pattern 102 both supported on the top of a drag flask stool 104 which in turn is on a support 105. In the FIG. 9 construction and in contrast to that of the previous figures, the drag flask 100 has annular bushings 106 in flange 108 which receives the drag pattern stool locator pins 110, which are mounted in bushings 112 in top of the drag stool 104.

As with the cope pattern stool and flask arrangement, there are two guide pins which are not shown, and two locator pins and only locator pin 110 is shown. However, in the case of the drag pattern, the locator and guide pins are secured in the drag pattern stool by press fit in bushings, such as the bushing 112, for locator pin 110. The locator pins 110 extend upward for engagement within the bushings 106 in the drag flask 100. In other details, the arrangement is substantially the same as the construction of FIGS. 1-5. The flask displacement mechanism 116 accordingly is connected by end plates to pivot pins in the support bracket 118. As in FIGS. 1-5, a bladder 120 is selectively charged with air from a source to swing the flask displacement mechanism 116 through a limited arc as shown in FIG. 9. The drag flask is displaced by the contact member 121 and resultantly is centered relative to the flask pattern by the force of the air pressure as transmitted through the flask displacement mechanism to the flange of the drag flask. This action linearly displaces the flask until clearance C' between the locator pin 110 and the bushing 106 is taken up and drag flask is accurately centered relative to its pattern.

After centering, the drag flask and pattern are maintained in this relatively moved position by maintaining pressure in the bladder. This precise centering is also maintained while molding sand is poured into the flask and over the pattern during jolting and core sand compaction.

After the drag mold has hardened, the air pressure is exhausted from the bladder and the springs return the flask displacement mechanism to its FIG. 9 position. Then the flask with its hardened molding therein is then stripped from its stool 104.

Figure 8:
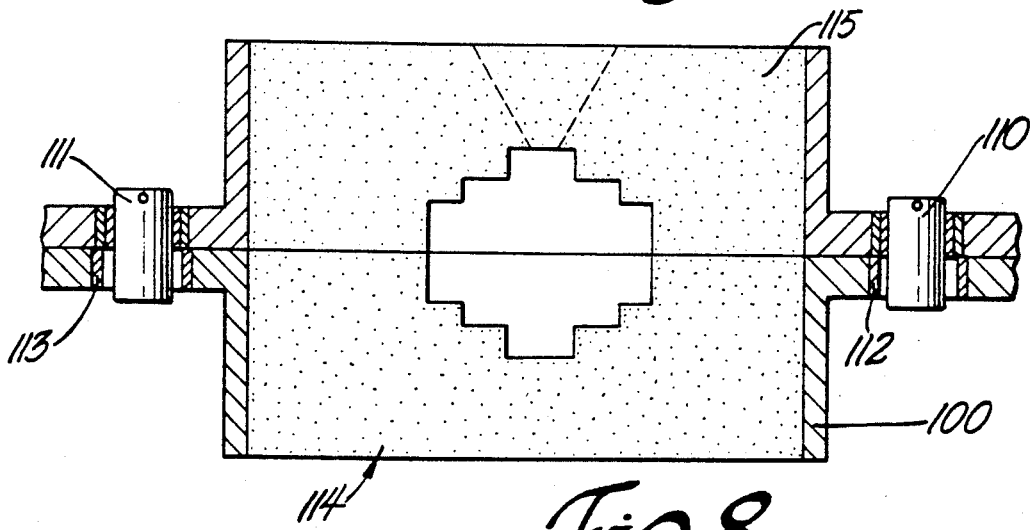
FIG. 8 is a cross sectional diagrammatic view of cope and drag molds mated with centering pins to provide a mold for a casting.

Subsequently, the drag mold 114 can be mated with the cope mold 115, as in FIG. 8, ready for casting operation. With this arrangement, the locator pins 110, 111 will mate with greater accuracy with corresponding sacrificial bushings 112, 113 in the drag flask, as diagrammatically shown in FIG. 8.

Figure 10:
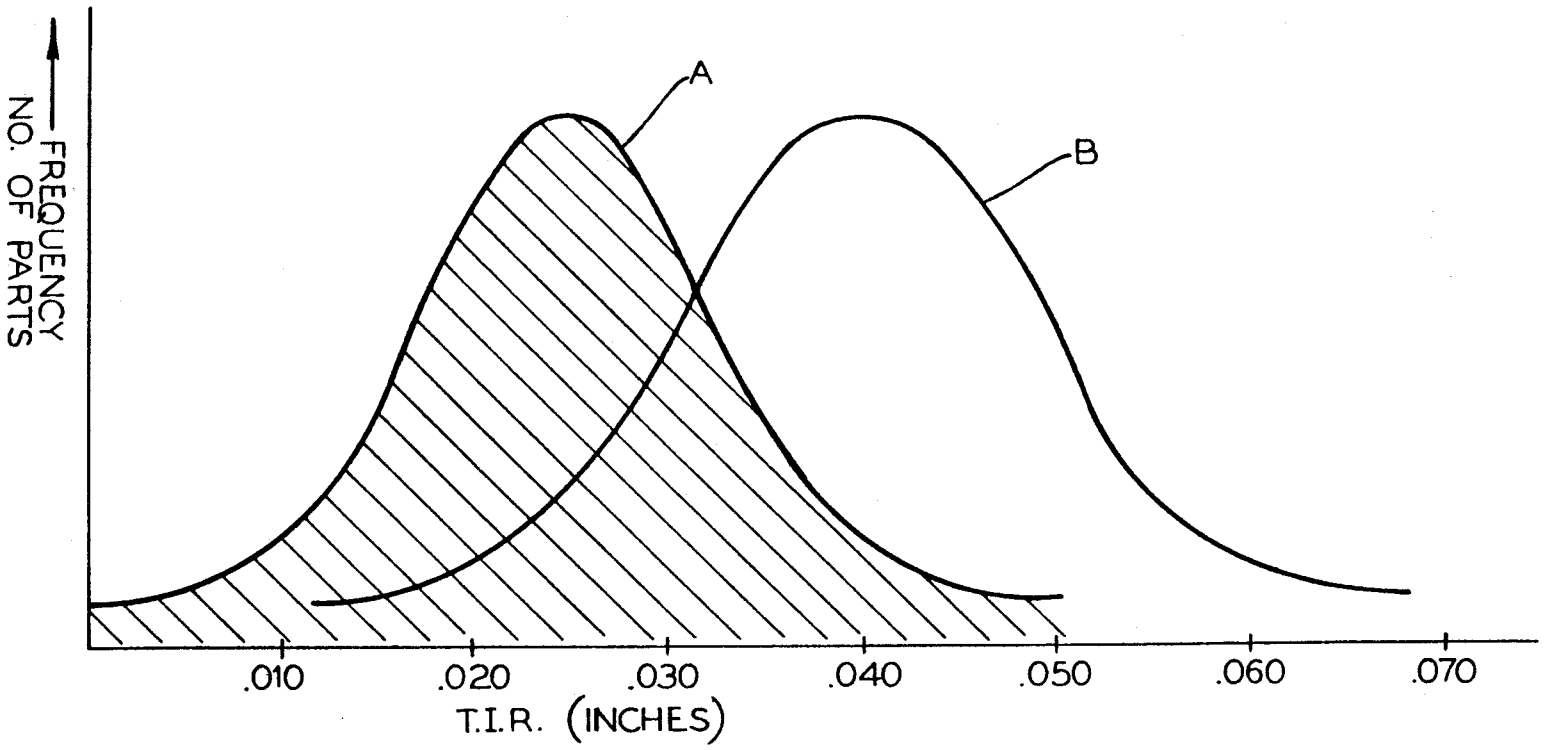
FIG. 10 is a curve illustrating an improvement provided by the present invention as compared to a prior mold making machine using only centering pin location.

With this matching of the cope and drag pattern, the offset will be only by the amount of the clearance between the cope mold locator pins and the drag pattern flask locator bushings 112, 113 so that there is improvement in the total indicator reading over any given run of molds. This improvement is illustrated in FIG. 10 with the curves A and B. Curve A shows the total indicator reading of a 50 piece run using the present invention as compared to the curve B in which only locator pin and bushing centering is used. With the frequency representing the number of components on the ordinate and the total indicator reading on the abscissa. Curve A shows that the range extends from a small number of parts that have no offset at their parting line through a majority of parts having from 0.010 to 0.040 in offset and tapering off to a small number having a relatively large offset of 0.050. This range is however a substantial improvement when only locator pin centering is used, as shown by curve B. In curve B the total indicator reading shows that there are no parts without a parting line step and the parting line step of most of the parts of curve B is substantially greater than that of the present invention, as shown by curve A. Accordingly, with the present invention, there is improved total indicator reading provided by this invention over prior art pin and bushing locator constructions.

With this invention, conventional internal pins and bushings on flask and support stools are employed for repetitive and accurate centering of the flask relative to a pattern supported on the stool without using external stopping mechanisms. The load or force used to take up the naturally occurring pin and bushing clearances for centering can be readily maintained during jolting and tamping. Furthermore, with this construction the lightweight actuator mechanism for providing the centering force does not add substantial mass to the cope and drag stools so that balance is not adversely affected.

While the above description constitutes preferred embodiments of the invention, it will be appreciated that the invention can be modified and varied without departing from the scope of the accompanying claims.

We claim:

1. A method of making a sand mold component with a flash unit and a mold pattern while positioned on a support unit comprising the steps of providing a locator pin in one of said units and a locator pin bushing in the other of said units, placing said flask unit on said support unit so that said locator pin fits into said bushing and locates said flask unit in a first position on said support unit, shifting said flask unit from said first position and on said support unit relative to said mold pattern so that a contact surface on the periphery of said locator pin physically contacts a contact surface of said bushing to remove any apparent clearance between said pin and bushing to thereby position said flask unit in a second and predetermined relative position with respect to said pattern, adding mold sand into said flask unit to surround said pattern, compacting said sand around said mold pattern until it forms a hardened profile of said pattern and stripping said flask unit and hardened mold sand from said support unit and said pattern to thereby completer formation of the sand mold component.

2. A method of making a sand mold for casting comprising the steps of positioning a walled flask on a support stool to augment alignment of said flask with respect to a mold pattern supported within the walls of said flask comprising the steps of providing a locator pin on said flask and a bushing in said support stool that are sized to mate with one another with clearance therebetween, holding said pattern stationary on said support stool, linearly shifting said flask so that a surface on the periphery of said locator pin physically contacts an inner surface of said bushing to take up clearance therebetween, and holding said flask in situ with said pin and bushing in contact while adding mold sand into said flask to cover said pattern, and jolting said support stool to effect the compacting of said sand over said mold pattern so that a cavity profiling said pattern is formed when said flask and compacted mold sand is removed from said support and said pattern.

3. A method of making a sand mold for casting comprising the steps of positioning a walled flask on a support stool to augment alignment of said flask with respect to a mold pattern supported on said stool within the walls of said flask comprising the steps of providing cooperating locator pin and bushing each having cylindrical wall means that interface with one another in said support stool and said flask and that are sized to mate with one another with clearance therebetween, holding said mold pattern stationary on said support stool, linearly shifting said flask so that a surface on the periphery of said locator pin physically contacts an inner surface of said bushing to take up clearance therebetween, and holding said flask in situ with said pin and bushing in contact while adding mold sand to said flask and subsequently jolting said support stool to effect compacting of said sand over said mold pattern to thereby make a mold ready for removal from said support stool and pattern.

4. A mold making machine for repetitively making cope and drag molds so that there will be minimized mismatch of paired cope and drag molds at their parting lines comprising a stool having an upper support surface, a pattern supported on said upper surface of said stool, a flask surrounding said pattern and positioned on said support surface of said stool, pin and bushing means in said support surface and said flask for positioning said flask in an initial position on said support surface, actuator means secured to said stool for moving said flask with respect to the pattern to take up clearance between said pin and bushing means to thereby accurately locate said flask with respect to said pattern so that mold sand can be supplied thereto for forming a mold which defines the profile of the pattern.

5. In a mold making machine, a support stool having an upper support surface, a mold pattern positioned in a predetermined position on said support surface, a flask surrounding said pattern and seated on said support surface, pin and pin bushing means associated with said flask and said support surface of said stool for locating said flask in a predetermined position on said support surface relative to said pattern, moving means for moving said flask to said support surface whereby said flask is located by said pin and bushing means, the improvement comprising an actuator affixed to said stool and incorporating motor means for displacing the flask on said support surface to take up clearance between said pin and bushing means to thereby accurately locate said flask relative to said pattern so that mold sand can be added to said flask and compressed to form a mold having a cavity that matches the profile of the pattern.

6. A mold making machine comprising a stool having an upper support surface and having an annular internal diameter bushing, a flask supported on said support surface and having a cylindrical locator pin mating with said bushing with clearance therebetween, a pattern surrounded by said flask and supported on said support surface an actuator for shifting the flask relative to the upper surface of said stool until said locator pin grounds on an inner surface of said bushing, said actuator including a connector base secured to said stool and a force transmitting mechanism operatively interposed between said stool and said flask, said actuator further comprising a pneumatically chargeable bladder operatively interposed between said connector base and said force transmitting mechanism, a source of pneumatic pressure for inflating said bladder for displacing said force transmitting mechanism until a portion of said force transmitting mechanism contacts said flask and urges said flask to a position in which said flask is precisely located with respect to said pattern encompassed by said flask, and spring means for returning said force transmitting mechanism to a start position subsequent to the release of pneumatic pressure from said bladder.

* * * * *